US011599040B2

(12) United States Patent
Fujita et al.

(10) Patent No.: US 11,599,040 B2
(45) Date of Patent: Mar. 7, 2023

(54) IMAGE FORMING METHOD, POST-PROCESSING DEVICE, AND ADJUSTING DEVICE

(71) Applicant: Konica Minolta, Inc., Tokyo (JP)

(72) Inventors: Michiyo Fujita, Hachioji (JP); Ryuichi Hiramoto, Kobe (JP); Kaori Matsushima, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/657,470

(22) Filed: Mar. 31, 2022

(65) Prior Publication Data

US 2022/0334511 A1 Oct. 20, 2022

(30) Foreign Application Priority Data

Apr. 14, 2021 (JP) ..... JP2021-068160

(51) Int. Cl.
*G03G 15/08* (2006.01)
*G03G 15/00* (2006.01)
*G03G 9/08* (2006.01)

(52) U.S. Cl.
CPC ..... *G03G 15/0865* (2013.01); *G03G 9/0808* (2013.01); *G03G 15/6573* (2013.01); *G03G 15/6585* (2013.01)

(58) Field of Classification Search
CPC ..... G03G 15/6585; G03G 15/6573
See application file for complete search history.

(56) References Cited

U.S. PATENT DOCUMENTS 5,149,610 A * 9/1992 Kobayashi ..... G03G 9/08 430/108.7
2002/0076635 A1* 6/2002 Yoshino ..... G03G 9/0926 430/111.41
2005/0025540 A1* 2/2005 Murai ..... G03G 15/2064 399/385
2013/0078001 A1* 3/2013 Koido ..... G03G 15/6585 399/223
2016/0086060 A1* 3/2016 Kubo ..... G06K 15/1878 399/38
2018/0348668 A1* 12/2018 Fujita ..... G03G 15/0865
2018/0367702 A1* 12/2018 Kubo ..... G03G 9/0926

FOREIGN PATENT DOCUMENTS

JP 2018-205694 A 12/2018

* cited by examiner

*Primary Examiner* — Carla J Therrien
(74) *Attorney, Agent, or Firm* — Lucas & Mercanti, LLP

(57) ABSTRACT

An image forming method includes supplying powder having metallic luster on a resin image arranged on a recording medium, wherein a color value of the resin image and a color value of the powder on the recording medium satisfy the following Equation (1):

$$\{(L^*_p-L^*_i-40)^2+(a^*_p-a^*_i)^2+(b^*_p-b^*_i)^2\}^{1/2}\leq 20 \quad (1)$$

wherein
$L^*_p$, $a^*_p$, and $b^*_p$ represent color values of the powder, and $L^*_i$, $a^*_i$, and $b^*_i$ represent color values of the resin image on the recording medium.

11 Claims, 7 Drawing Sheets

IMAGE FORMING METHOD, POST-PROCESSING DEVICE, AND ADJUSTING DEVICE

The entire disclosure of Japanese patent Application No. 2021-068160, filed on Apr. 14, 2021, is incorporated herein by reference in its entirety.

BACKGROUND

Technological Field

The present invention relates to an image forming method, a post-processing device, and an adjusting device.

Description of the Related Art

In recent years, demand for decorative printing and high value added printing has increased in the on-demand printing market. For example, metallic printing capable of imparting metallic luster has attracted attention as one of such decorative printing and high value added printing.

JP 2018-205694 A proposes a method of adjusting texture of an image by supplying a surface of a resin image with powder. For example, by using powder having metallic luster, metallic luster can be imparted to an image.

As described above, in an image supplied with powder, it is desirable that the difference between the color of the powder and the color of the resin image be inconspicuous.

SUMMARY

Therefore, an object of the present invention is to provide an image forming method, a post-processing device, and an adjusting device capable of making a difference between a color of powder and a color of a resin image inconspicuous.

To achieve the abovementioned object, according to an aspect of the present invention, an image forming method reflecting one aspect of the present invention comprises supplying powder having metallic luster on a resin image arranged on a recording medium, wherein a color value of the resin image and a color value of the powder on the recording medium satisfy the following Equation (1):

$$\{(L^*_p-L^*_i-40)^2+(a^*_p-a^*_i)^2+(b^*_p-b^*_i)^2\}^{1/2}\leq 20 \quad (1)$$

wherein $L^*_p$, $a^*_p$, and $b^*_p$ represent color values of the powder, and $L^*_i$, $a^*_i$, and $b^*_i$ represent color values of the resin image on the recording medium.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more preferred embodiments of the present invention will be described with reference to the drawings. However, the scope of the invention is not limited to the disclosed embodiments. In the present specification, "X to Y" indicating a range includes X and Y, and means "equal to or greater than X and equal to or less than Y". In the present specification, unless otherwise specified, operations and measurements of physical properties and the like are performed under the conditions of room temperature (20 to 25° C.)/relative humidity 40 to 50% RH.

First Embodiment

[Configuration of Image Forming System 1]

Figure 1:
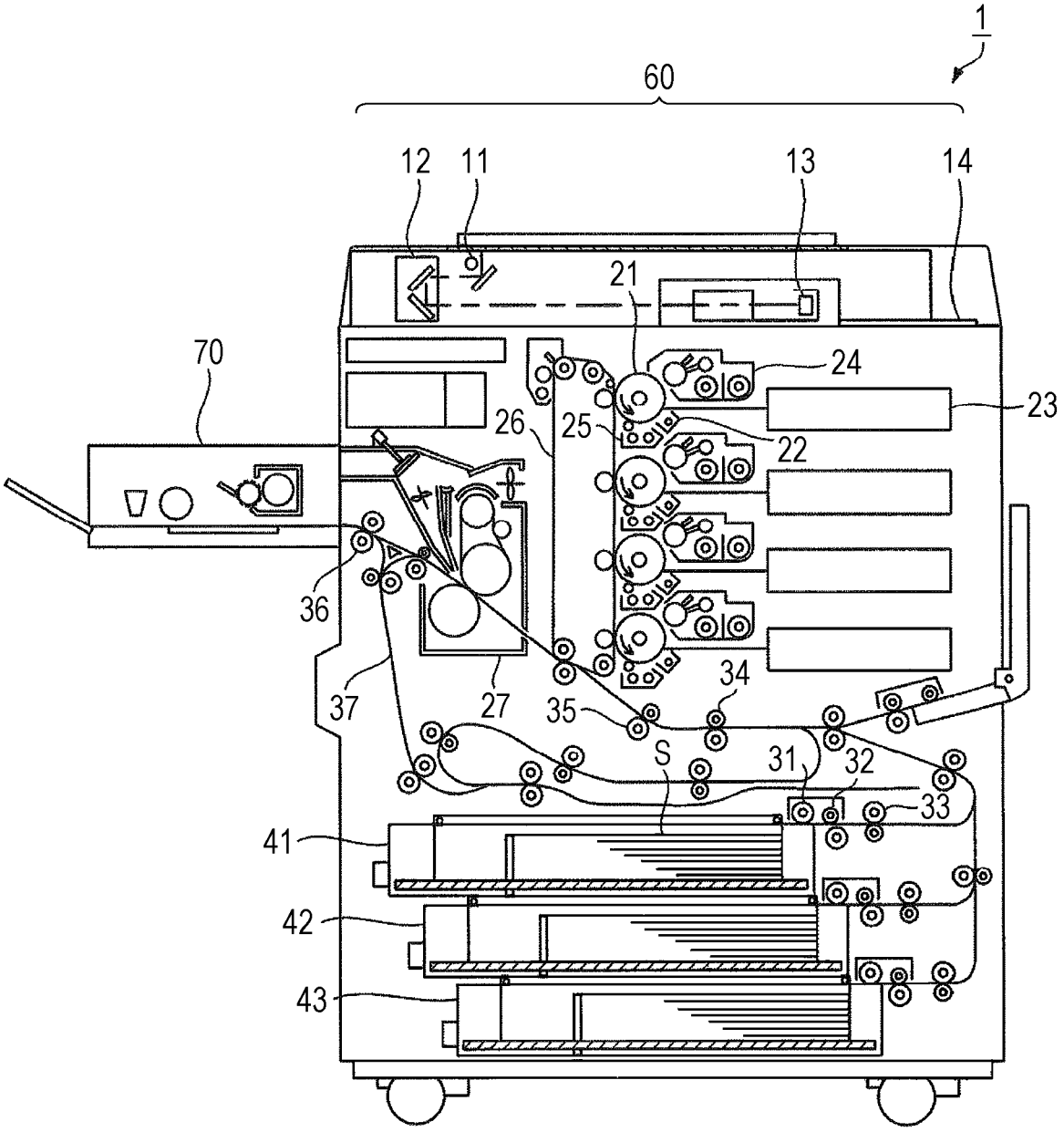
FIG. 1 is a schematic diagram illustrating an example of a schematic configuration of an image forming system according to a first embodiment of the present invention.

FIG. 1 schematically illustrates an overall configuration of an image forming system 1 according to a first embodiment of the present invention. The image forming system 1 includes an image forming apparatus 60 and a post-processing device 70. The image forming apparatus 60 forms a resin image on a recording medium S. The post-processing device 70 performs post-processing on the resin image formed by the image forming apparatus 60. The image forming system 1 includes, for example, a controller (not illustrated) that controls the image forming apparatus 60 and the post-processing device 70. Each of the image forming apparatus 60 and the post-processing device 70 may be provided with the controller.

The image forming apparatus 60 is, for example, an electrophotographic image forming apparatus, and includes an image reader, an image former, a sheet conveyor, a sheet feeder, and the like. In the image forming apparatus 60, for example, a color toner image is formed.

The image reader includes, for example, a light source 11, an optical system 12, an imaging element 13, and an image processing part 14.

For example, the image former forms toner images of yellow (Y), magenta (M), cyan (C), and black (K), and transfers the toner images to an intermediate transfer belt 26. The image former includes, for example, a photosensitive drum 21, a charger 22, an optical writer 23, a developing device 24, and a drum cleaner 25 for each of Y, M, C, and K. The image former may form a clear (CL) toner image. The toner contains, for example, a resin such as a thermoplastic resin. Here, the toner corresponds to a specific example of an image forming material of the present invention.

The thermoplastic resin contained in the toner can be appropriately selected from various known thermoplastic resins, and one kind or more may be selected. For example, the toner includes a styrene-based resin, a (meth) acrylic resin, a styrene-(meth) acrylic copolymer resin, a vinyl-based resin such as an olefin-based resin, a polyester resin, a polyamide-based resin, a polycarbonate resin, a polyether resin, a polyvinyl acetate-based resin, or the like. In particular, a styrene-based resin, an acrylic resin, or a polyester resin is preferable.

The photosensitive drum 21 is a rotating body. The charger 22 is disposed around the photosensitive drum 21. The intermediate transfer belt 26 is wound by a plurality of rollers and is supported so as to be able to travel.

The sheet conveyor includes, for example, a delivery roller 31, a separation roller 32, a conveyance roller 33, a loop roller 34, a registration roller 35, a sheet discharge roller 36, and a sheet reversing part 37. The color toner image formed on the intermediate transfer belt 26 is transferred onto the recording medium S conveyed along a conveyance path of the sheet conveyor. The sheet feeder includes a plurality of sheet feeding trays 41, 42, 43 that accommodate the recording medium S.

The color toner image transferred from the intermediate transfer belt 26 to the recording medium S is fixed to the recording medium S by a fixing part 27. As a result, a resin image (a resin image 100 in FIG. 2 described later) is formed on the recording medium S. The resin image on the recording medium S is, for example, an image not having metallic luster, a so-called solid color image, and has a color value represented by $L^*_i$, $a^*_i$, and $b^*_i$.

The recording medium S is not particularly limited as long as an image can be formed thereon. The recording medium is not particularly limited, and examples thereof include: paper such as plain paper from thin paper to thick paper, high-quality paper, coated printing paper such as art paper or coated paper, water-soluble paper, and commercially available Japanese paper and postcard paper; plastic films such as a polypropylene (PP) film, a polyethylene terephthalate (PET) film, and a triacetyl cellulose (TAC) film; and cloth and leather, but the recording medium is not limited thereto. The color of the recording medium is not particularly limited, and recording media of various colors can be used. The recording medium may be transparent or opaque.

The recording medium S on which the toner image is fixed is conveyed to the post-processing device 70 via the sheet discharge roller 36. The recording medium S on which the toner image is fixed may be sent to the sheet reversing part 37. The recording medium S sent to the sheet reversing part 37 is reversed and discharged. Thus, images can be formed on both sides of the recording medium S.

Figure 2:
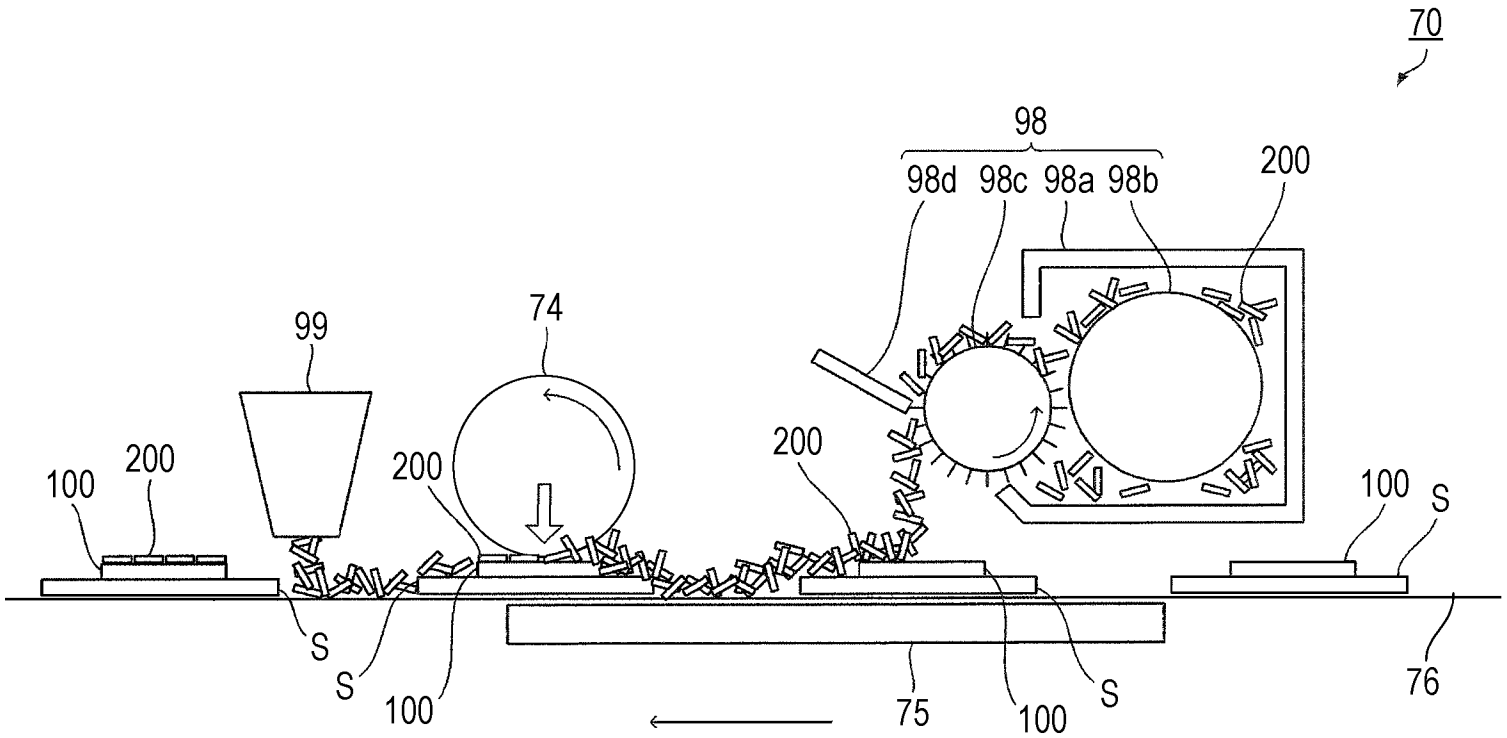
FIG. 2 is a schematic diagram illustrating an example of a configuration of a post-processing device illustrated in FIG. 1.

FIG. 2 is an enlarged view of the post-processing device 70 illustrated in FIG. 1. The post-processing device 70 supplies powder (powder 200 in FIG. 2 described later) onto a resin image (resin image 100) arranged on the recording medium S. The post-processing device 70 includes, for example, a rubbing roller 74, a heater 75, a conveyance path 76, a powder spreading part 98, and a powder collecting part 99. Here, the powder spreading part 98 corresponds to a specific example of a powder supplier of the present invention.

The powder spreading part 98 spreads the powder 200 on the recording medium S. The powder spreading part 98 includes, for example, a container 98*a*, a conveyance screw 98*b*, a brush roller 98*c*, and a flicker 98*d*.

The container 98*a* accommodates the powder 200. The powder 200 accommodated in the container 98*a* has metallic luster. Here, the metallic luster may be luster of metal itself, or may be luster similar to that of metal emitted from a substance other than metal. The powder 200 is supplied to the surface of the resin image 100 to form a metallic image (so-called metallic image). That is, the decorative effect of the powder 200 on the resin image 100 is exhibited. A more specific configuration of the powder 200 will be described later.

The container 98*a* accommodating the powder 200 is provided with an opening toward the brush roller 98*c*. The powder 200 held in the container 98*a* is conveyed to the brush roller 98*c* through the opening of the container 98*a*. An edge of the opening of the container 98*a* is able to contact, for example, a tip of a brush of the brush roller 98*c*. This makes it possible to control the amount of the powder 200 held by the brush roller 98*c*.

The conveyance screw 98*b* is arranged inside the container 98*a* together with the powder 200, for example. When the conveyance screw 98*b* rotates, the powder 200 accommodated in the container 98*a* is conveyed to the vicinity of the opening of the container 98*a*.

The brush roller 98*c* is arranged in the vicinity of the opening of container 98*a*. The powder 200 conveyed to the vicinity of the opening of the container 98*a* by the conveyance screw 98*b* is held by the brush of the brush roller 98*c*. Brush roller 98*c* is rotatable, and rotates counterclockwise (in the direction of the arrow in FIG. 2), for example.

The flicker 98*d* serves to separate the powder 200 from the brush of the brush roller 98*c*. The flicker 98*d* is, for example, a plate-like member, and when one end of the flicker 98*d* bites into the brush of the rotating brush roller 98*c*, the powder 200 adhering to the brush of the brush roller 98*c* is repelled, and the powder 200 is separated from the brush roller 98*c*. The powder 200 separated from the brush roller 98*c* drops on the surface of the recording medium S on the conveyance path 76 along the gravity direction (downward).

The position where one end of the flicker 98*d* and the brush roller 98*c* are in contact with each other is, for example, away from the container 98*a*. The bite amount of the flicker 98*d* into the brush roller 98*c* is determined in consideration of, for example, the supply amount of the powder 200 and uneven wear of the brush. The brush bristle length and the brush density of brush roller 98*c* are determined in consideration of, for example, the supply amount of powder 200 and dripping thereof.

The position of the flicker 98*d* may be fixed so that one end thereof comes into contact with the brush roller 98*c*, or may be displaced so as to be separated from the brush roller 98*c* when the rotation of the brush roller 98*c* is stopped.

The rubbing roller 74 is arranged downstream of the powder spreading part 98 in the conveyance direction of the recording medium S, and rubs the surface of the recording medium S on which the powder 200 is spread. Here, "rubbing the surface of the recording medium S" means that the rubbing roller 74 moves relative to the resin image 100 while being in contact with the surface of the resin image 100 arranged on the recording medium S and along the surface. When the rubbing roller 74 rubs the surface of the recording medium S on which the powder 200 is spread, the powder 200 is oriented in a predetermined direction and attached to the resin image 100. The rubbing by the rubbing roller 74 is preferably accompanied by pressing. The term "pressing" refers to pressing the surface of the resin image 100 in a direction (for example, in the vertical direction)

intersecting the surface of the resin image 100. By performing rubbing with pressing, the powder 200 can be sufficiently oriented, and the powder 200 can be adhered to the resin image 100 with sufficient strength.

The rubbing roller 74 includes, for example, a cylindrical core metal and an elastic layer such as a resin sponge arranged on the outer peripheral surface of the cylindrical core metal. An elastic layer of the rubbing roller 74 preferably has flexibility, and may be, for example, a brush or the like.

The rubbing roller 74 includes, for example, a rotation shaft in a direction (for example, when the length direction of the sheet surface is parallel to the extending direction of the conveyance path 76, the width direction of the paper surface) perpendicular to the extending direction of the conveyance path 76, and is rotatable in a direction of an arrow in FIG. 2. As a result, at the contact portion between the rubbing roller 74 and the recording medium S, they move in opposite directions. That is, the rubbing roller 74 moves relative to the resin image 100. The contact width of the rubbing roller 74 on the surface of the resin image 100 is preferably 1 mm to 200 mm. By setting the contact width of the rubbing roller 74 on the surface of the resin image 100 to equal to or greater than 1 mm, the direction of the powder 200 is easily aligned, and the powder 200 is easily oriented along the surface of the resin image 100. By setting the contact width of the rubbing roller 74 on the surface of the resin image 100 to equal to or less than 200 mm, the conveyance performance of the recording medium S can be easily maintained.

The rubbing roller 74 preferably rotates so that the relative speed with respect to the resin image 100 is 5 to 500 mm/sec. By setting the relative speed of the rubbing roller 74 with respect to the resin image 100 to equal to or greater than 5 mm/sec, it is easy to sufficiently orient the powder 200 along the surface of the resin image 100. By setting the relative speed of the rubbing roller 74 with respect to the resin image 100 to equal to or less than 500 mm/sec, the powder 200 can be easily attached to the surface of the resin image 100 with sufficient strength. Since the powder 200 is sufficiently oriented along the surface of the resin image 100 and attached with sufficient strength, a clear metallic image can be obtained.

The rubbing roller 74 is biased toward the conveyance path 76 by a biasing member (not illustrated), for example, and presses the surface of the recording medium S conveyed through the conveyance path 76. When the elastic layer of the rubbing roller 74 has flexibility, the surface (elastic layer) of the rubbing roller 74 is deformed following the shape of the surface of the resin image 100 at the time of pressing. As a result, disturbance of the resin image 100 can be suppressed.

The pressing force of the rubbing roller 74 is preferably 1 to 30 kPa with respect to the surface of the resin image 100. When the rubbing roller 74 presses the surface of the resin image 100 with a force of equal to or greater than 1 kPa, the powder 200 can be attached to the surface of the resin image 100 with sufficient strength. Since the rubbing roller 74 presses the surface of the resin image 100 with a force of equal to or less than 30 kPa, it is possible to suppress disturbance of the resin image 100 and to suppress an increase in torque when the resin image 100 is conveyed. Accordingly, since the rubbing roller 74 has a pressing force of 1 to 30 kPa with respect to the surface of the resin image 100, the resin image 100 can be smoothly conveyed, and the attaching strength of the powder 200 can be increased while suppressing the disturbance of the resin image 100.

The heater 75 plays a role of softening the resin image 100 arranged on the recording medium S. By softening the resin image 100, the powder 200 is easily attached to the resin image 100. The heater 75 faces the powder spreading part 98 and the rubbing roller 74 with the conveyance path 76 interposed therebetween, for example, and heats the surface opposite to the surface of the recording medium S to which the powder 200 is supplied. The heater 75 may soften the resin image 100 before the powder 200 is supplied to the surface of the recording medium S, or may soften the resin image 100 after the powder 200 is supplied to the surface of the recording medium S. The supply of the powder 200 to the surface of the recording medium S and softening of the resin image 100 may be performed at the same time. The heater 75 is, for example, a hot plate.

The temperature at which the resin image 100 is softened is, for example, a temperature at which the powder 200 starts to be attached to the surface of the resin image 100 when the temperature of the resin image 100 at room temperature is gradually increased. This temperature can be measured, for example, as follows. First, the hot plate is heated to a predetermined temperature, and the resin image 100 formed on the recording medium S is placed thereon. Next, the surface of the resin image 100 is lightly rubbed with an eye shadow chip sponge portion or the like to which the powder 200 is attached. Thereafter, whether the powder 200 is attached to the surface of the resin image 100 is checked. In this manner, the softening temperature of the resin image 100 can be determined by increasing the set temperature of the hot plate by, for example, 5° C. and searching for the temperature at which the powder 200 starts to be attached to the surface of the resin image 100.

The powder collecting part 99 is arranged downstream of the rubbing roller 74 in the conveyance direction of the recording medium S, and removes excess powder 200 from the surface of the recording medium S. The powder collecting part 99 is, for example, a powder collector for sucking the powder 200 from the surface of the recording medium S. The powder collector has, for example, a suction port arranged at a position at an appropriate height from the conveyance path 76 of the recording medium S, and sucks the powder 200 through the suction port. For example, the powder collector is formed to operate at an output that sucks the powder 200 and does not suck the recording medium S.

Here, a specific configuration of the powder 200 will be described. The powder 200 is formed of, for example, an aggregate of powder particles. The powder 200 having metallic luster contains, for example, metal powder. The metal powder contains, for example, aluminum, silver, platinum, chromium, nickel, rhodium, iron, gold, copper, or the like. Examples of the powder particles include metal particles, resin particles, magnetic particles, and nonmagnetic particles. The powder particles may include two or more different materials. The shape of the powder particles may be spherical particles or non-spherical particles. The powder 200 may be a synthetic product or a commercially available product. The powder 200 may be a mixture of two or more different types of powder particles. The powder 200 is not a toner.

The powder particles may be coated. For example, the metal particles may be coated with a metal, a metal oxide, a resin, or the like different from the metal, or may be coated with a metal, a metal oxide, or the like on the surface of a resin, glass, or the like. The metal particles may be metal oxide particles, or may be coated with metal oxide, metal, resin, or the like different from the metal oxide. The metal particles may be those obtained by spreading and pulverizing a metal or a metal oxide in a plate shape, those obtained by coating the metal particles with various materials, or those obtained by depositing or wet-coating a metal or a metal oxide on a film or glass. The metal particles preferably contain a metal or a metal oxide, and the content of the metal or the metal oxide is preferably 0.2 mass % to 100 mass % with respect to 100 mass % of the powder.

The non-spherical particles are particles other than spherical particles. The spherical particles are particles whose projected shape has an average circularity of equal to or greater than 0.970 when 100 powder particles are randomly selected. The average circularity can be obtained by a known method or may be a catalog value.

The non-spherical particles are preferably flat particles having a flat particle shape from the viewpoint of orienting the powder particles along the surface of the resin layer. The "flat particle shape" of the non-spherical particle means a shape in which a ratio of a short diameter to a thickness (short diameter/thickness) is equal to or greater than 5, where a maximum length in the non-spherical particle is a long diameter, a maximum length in a direction orthogonal to the long diameter is a short diameter, and a minimum length in a direction orthogonal to both the long diameter and the short diameter is a thickness.

The long diameter, short diameter, and thickness of the powder particles are measured as follows using a scanning electron microscope. The powder particles are adhered to the carbon tape so as to increase the contact area, and used as a measurement sample. The long diameter and the short diameter are measured by observing the powder particles from directly above the surface of the carbon tape with a scanning electron microscope. On the other hand, the thickness is measured by observing powder particles with a scanning electron microscope from right beside the surface of the carbon tape.

The flat particle shape preferably has a long diameter of equal to or greater than 10 μm and equal to or less than 100 μm, and a short diameter of equal to or greater than 10 μm and equal to or less than 100 μm, from the viewpoint of orienting the powder particles obliquely with respect to the surface of the recording medium.

The flat particle shape is preferably a particle having a thickness of equal to or greater than 0.2 μm and equal to or less than 3.0 μm, and more preferably equal to or greater than 1 μm and equal to or less than 2 μm. When the thickness of the flat particle shape is equal to or greater than 0.2 μm, the powder oriented along the surface of the resin image 100 easily exhibits a desired appearance. When the thickness of the flat particle shape is equal to or less than 3.0 μm, the powder is hardly peeled off when an image is rubbed.

Examples of the non-spherical particles include Sunshine Baby Chromium Powder, Aurora Powder, and Pearl Powder (all manufactured by GG Corporation), ICEGEL Mirror Metal Powder (manufactured by TAT Corporation), PIKA-ACE MC shine dust, Effect C (manufactured by KURACHI LTD., "PIKA-ACE" is a registered trademark of the company), PREGEL Magic Powder, Mirror Series (manufactured by PREANFA Corporation, "PREGEL" is a registered trademark of the company), Bonnail Shine Powder (manufactured by K's Planning co., ltd., "BON NAIL" is a registered trademark of the company), META SHINE (manufactured by Nippon Sheet Glass Co., Ltd., registered trademark of the company), ELgee neo (manufactured by OIKE & Co., Ltd., registered trademark of the company), Astro Flake (manufactured by FUKUDA METAL FOIL & POWDER CO., LTD.), and aluminum pigment (manufactured by Toyo Aluminium K.K.).

Such powder 200 has color values represented by $L^*_p$, $a^*_p$, and $b^*_p$. In the present embodiment, the color value of the powder 200 and the color value of the resin image 100 on the recording medium S satisfy the following Equation (1). As will be described in detail later, this reduces the difference between the color of the powder 200 and the color of the resin image 100, making it possible to make the difference between the color of the powder 200 and the color of the resin image less inconspicuous. The difference between the color of the powder and the color of the resin image includes a difference in brightness and a difference in color tone between the powder and the resin image.

$$\{(L^*_p-L^*_i-40)^2+(a^*_p-a^*_i)^2+(b^*_p-b^*_i)^2\}^{1/2}\leq 20 \quad (1)$$

wherein $L^*_p$, $a^*_p$, and $b^*_p$ represent color values of the powder 200, and $L^*_i$, $a^*_i$, and $b^*_i$ represent color values of the resin image 100 on the recording medium S.

The color value of the powder 200 and the color value of the resin image 100 on the recording medium S preferably further satisfy the following Equation (2). As a result, the difference between the color of the powder 200 and the color of the resin image 100 becomes inconspicuous.)

$$\{(a^*_p-a^*_i)^2+(b^*_p-b^*_i)^2\}^{1/2}\leq 10 \quad (2)$$

The color value of the powder 200 is measured under the following conditions, for example. The color value of the powder 200 is measured, for example, including specular reflection light:

Measuring apparatus: Spectrophotometer CM-3600d manufactured by KONICA MINOLTA, INC.

Cell: glass cell CM-A98 (optical path length 10 mm, powder 200 is filled in height of 20 mm)

Measurement diameter: 8 mm

Measurement method: Specular Component Include (SCI)

Light source: D50

Observation conditions: 2° field of view.

The color value of the resin image 100 on the recording medium S is measured under the following conditions, for example. The color value of the resin image 100 on the recording medium S is measured without including specular reflection light, for example. Here, the color values of the recording medium S and the resin image 100 are measured. For example, when the resin image 100 having optical transparency is provided on the recording medium S, a color value obtained by subjecting the color of the recording medium S and the color of the resin image 100 to subtractive color mixing is measured:

Measuring apparatus: Fluorescence spectrophotometer FD-7 manufactured by KONICA MINOLTA, INC.

Measurement method: Specular Component Exclude (SCE)

Light source: D50

Observation conditions: 2° field of view.

[Image Forming Method of Image Forming System 1]

Figure 3:
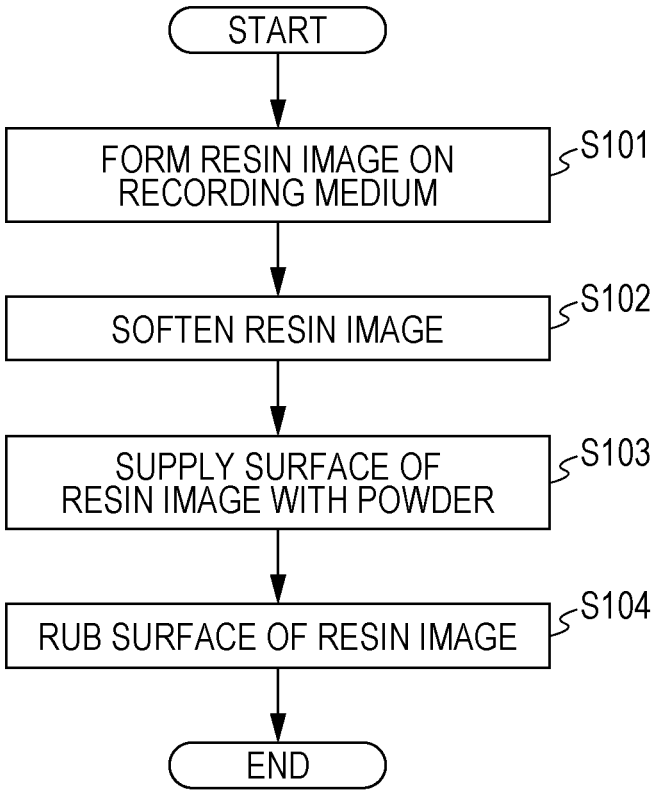
FIG. 3 is a flowchart illustrating an example of an image forming method of the image forming system illustrated in FIG. 1.

FIG. 3 is a flowchart illustrating an image forming method using the image forming system 1.

First, the image forming system 1 forms the resin image 100 on the recording medium S by the image forming apparatus 60 (step S101). The image forming apparatus 60 forms the resin image 100 on the recording medium S as follows, for example.

First, the image reader of the image forming apparatus 60 irradiates the document placed on the reading surface with light from the light source 11. When the light is reflected by the document, the reflected light forms an image on the imaging element 13 moved to a reading position via a lens and a reflecting mirror of the optical system 12. The imaging element 13 generates an electric signal according to the intensity of the reflected light from the document. The generated electric signal is converted from an analog signal to a digital signal in the image processing part 14, then subjected to correction processing, filter processing, image compression processing, and the like, and stored as image data in a memory of the image processing part 14. As described above, the image reader reads an image of a document and stores image data.

Next, the image former forms a toner image on the basis of the image data. The toner image is formed, for example, as follows. First, the charger 22 of the image former charges the surface of the photosensitive drum 21 rotating at a predetermined speed to a desired potential. Next, the optical writer 23 writes an image information signal on the photosensitive drum 21 on the basis of the image data, and forms a latent image based on the image information signal on the photosensitive drum 21. Thereafter, the latent image is developed by the developing device 24, and a toner image as a visible image is formed on the photosensitive drum 21. As described above, unfixed toner images of yellow, magenta, cyan, and black are formed on the photosensitive drums 21 of the respective image former of YMCK.

The toner images of the respective colors formed by the respective image formers of YMCK are sequentially transferred onto the traveling intermediate transfer belt 26 by a primary transfer part. As described above, a color toner image in which toner layers of respective colors of yellow, magenta, cyan, and black are superimposed is formed on the intermediate transfer belt 26.

Next, a secondary transfer roller transfers the color toner image on the intermediate transfer belt 26 to the recording medium S conveyed from the sheet feeding trays 41, 42, 43. Thereafter, the fixing part 27 applies heat and pressure to the recording medium S, so that the color toner image on the recording medium S is fixed to the recording medium S. As described above, the image forming apparatus 60 forms the resin image 100 on the recording medium S.

The attachment amount of the toner on the recording medium S is preferably 0.1 $g/m^2$ to 25.0 $g/m^2$, and more preferably 2.0 $g/m^2$ to 20.0 $g/m^2$. By setting the attachment amount of the toner on the recording medium S to equal to or greater than 0.1 $g/m^2$, the powder 200 is easily fixed, and by setting the attachment amount of the toner on the recording medium S to equal to or less than 25.0 $g/m^2$, the occurrence of fixing failure or the like can be suppressed. That is, by setting the attachment amount of the toner on the recording medium S to 0.1 $g/m^2$ to 25.0 $g/m^2$, the powder 200 is easily brought into close contact with the resin image 100 in a subsequent process. The recording medium S on which the resin image 100 is formed is sent to the post-processing device 70 via the sheet discharge roller 36.

The image forming apparatus 60 may form the resin image 100 on both surfaces of the recording medium S. At this time, the image forming apparatus 60 guides the recording medium S having the resin image 100 fixed on one surface to the sheet reversing part 37, and reverses the front and back of the recording medium S and discharges the recording medium S.

After the image forming apparatus 60 forms the resin image 100 on the recording medium S, the image forming system 1 conveys the recording medium S onto the heater 75 of the post-processing device 70 by the conveyance path 76 to soften the resin image 100 (step S102). Specifically, the heater 75 heats the resin image 100 from the back surface (the surface opposite to the surface on which the resin image 100 is formed) side of the recording medium S. As a result, the resin included in the resin image 100 is softened, and the adhesiveness of the surface of the resin image 100 is improved. The post-processing device 70 may soften the entire resin image 100 or may soften a partial region of the resin image 100.

Next, the image forming system 1 conveys the recording medium S to the powder spreading part 98. The powder spreading part 98 supplies the powder 200 to the surface of the resin image 100 on the recording medium S as follows, for example (step S103). First, the powder 200 contained in the container 98*a* is conveyed by the conveyance screw 98*b* and held by the brush roller 98*c* rotating counterclockwise. The powder 200 held by the brush roller 98*c* comes into contact with the flicker 98*d* to be separated from the brush roller 98*c*, and drops onto the recording medium S along gravity. For example, the powder 200 is supplied to the surface of the resin image 100 on the recording medium S in this manner.

The image forming system 1 may soften the resin image 100 after supplying the powder 200 to the surface of the resin image 100 on the recording medium S. Alternatively, the resin image 100 may be softened at the same time as supplying the powder 200 to the surface of the resin image 100 on the recording medium S.

The image forming system 1 supplies the powder 200 to the surface of the resin image 100 on the recording medium S, and then rubs the recording medium S while pressing the recording medium S using the rubbing roller 74 (step S104). Specifically, when the rubbing roller 74 rotates counterclockwise, the rubbing roller 74 moves relative to the resin image 100 on the recording medium S, and the surface of the resin image 100 supplied with the powder 200 is rubbed. As a result, the powder 200 is oriented along the surface of the resin image 100 and attached to the surface of the resin image 100. The powder 200 that has not been attached to the surface of the resin image 100 is removed from the surface of the resin image 100 by the rubbing roller 74 and collected by the powder collecting part 99.

Figure 4A:
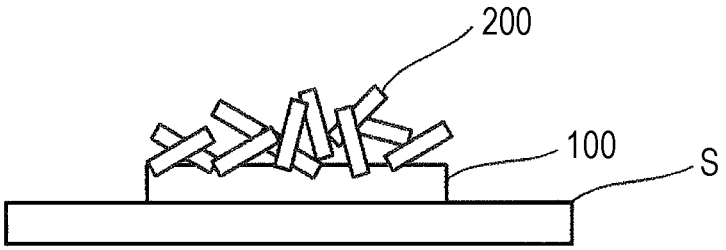
FIG. 4A is a schematic diagram illustrating a resin image and powder before the process of step S104 illustrated in FIG. 3.
Figure 4B:
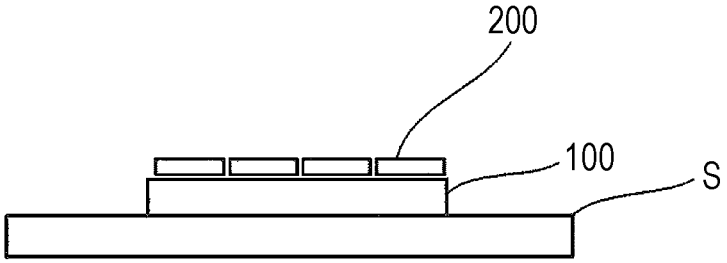
FIG. 4B is a schematic diagram illustrating a resin image and powder after the process of step S104 illustrated in FIG. 3.

FIG. 4A schematically illustrates a state of the powder 200 before rubbing, and FIG. 4B schematically illustrates a state of the powder 200 after rubbing. For example, the powder 200 spread by the powder spreading part 98 is attached to the surface of the resin image 100 in a state where the directions are different from each other (FIG. 4A). That is, the powder 200 before rubbing is not oriented. When the powder 200 has a flat particle shape, the powder 200 is easily arrayed along a plane including the major axis and the minor axis. Therefore, by rubbing the surface of the resin image 100 supplied with the powder 200, the major axis and the minor axis of the powder 200 are aligned in the direction orthogonal to the thickness direction of the resin image 100, and the powder 200 is oriented.

The resin image 100 on the recording medium S is preferably rubbed along the conveyance path 76 for a distance of 1 mm to 200 mm. By rubbing over a distance of equal to or greater than 1 mm, variations in the orientation direction of the powder 200 are less likely to occur, and the powder 200 attached to the resin image 100 can be sufficiently oriented. By setting this distance to equal to or less than 200 mm, an increase in the conveyance distance can be suppressed, and the recording medium S can be easily conveyed.

The image forming system 1 conveys the recording medium S along the conveyance path 76 after attaching the powder 200 to the surface of the resin image 100. For example, during the conveyance, the resin image 100 is cooled to room temperature, and the powder 200 is fixed to the surface of the resin image 100. As a result, a final image including the recording medium S, the resin image 100, and the powder 200 in this order, that is, a metallic image decorated with the powder 200 is formed.

For example, one layer of the powder 200 is substantially fixed to the surface of the resin image 100, and the coverage of the powder 200 with respect to the surface of the resin image 100 is, for example, about 30% to 80%. That is, a part of the surface of the resin image 100 is exposed from the powder 200. Therefore, an observer visually recognizes the reflected light from the surface of the resin image 100 and the reflected light from the powder 200.

In the present embodiment, as described above, the color value of the powder 200 and the color value of the resin image 100 on the recording medium S satisfy the above Equation (1). As a result, a difference between a color of the powder 200 and a color of the resin image 100 is reduced. Therefore, even if the coverage of the powder 200 on the resin image 100 varies, the observer is less likely to feel color unevenness due to the variation in coverage.

[Operation and Effect of Image Forming System 1]

In the post-processing device 70 of the image forming system 1 according to the present embodiment, since the color value of the powder 200 and the color value of the resin image 100 on the recording medium S satisfy the above Equation (1), the difference between the color of the powder 200 and the color of the resin image 100 is reduced. Accordingly, it is possible to make the difference between the color of the powder 200 and the color of the resin image 100 inconspicuous. Hereinafter, this operation and effect will be described in detail.

For example, when the difference between the color of the powder and the color of the resin image is large, the difference between the color of the powder and the color of the resin image is conspicuous. In particular, in a metallic image decorated with powder having metallic luster, an observer tends to strongly feel a difference between the color of the powder and the color of the resin image due to the following characteristics of the metallic image.

As the characteristics of the metallic image, when the observer observes the image from the direction of specular reflection with respect to the light source, mainly specular reflection light from the powder is visually recognized, and when the observer observes the image from a direction other than the direction of specular reflection with respect to the light source, composite light of diffuse reflection light from the resin image and diffuse reflection light from the powder is visually recognized. For this reason, when the difference between the color of the powder and the color of the resin image is large, the color of light visually recognized greatly differs depending on the observation direction, and the difference between the color of the powder and the color of the resin image is conspicuous.

When the difference between the color of the powder and the color of the resin image is large as described above, for example, a variation in the coverage of the powder on the resin image is recognized by the observer as color unevenness of the image. Due to the influence of the color of the resin image, the color tone of the powder cannot be utilized, and decorativeness by the powder may not be sufficiently obtained.

On the other hand, in the image forming system 1, since the color value of the powder 200 and the color value of the resin image 100 on the recording medium S satisfy the above Equation (1), the difference between the color of the powder 200 and the color of the resin image 100 is reduced. As a result, even in the metallic image decorated with the powder 200 having metallic luster, the difference between the color of the powder 200 and the color of the resin image 100 can be made inconspicuous. Therefore, even when the coverage of the powder 200 on the resin image 100 varies, the observer is less likely to feel color unevenness. Since the color of the resin image 100 is adapted to the color of the powder 200, the color tone of the powder 200 is utilized, and the decorativeness by the powder 200 is easily exhibited.

Since the color value of the powder 200 and the color value of the resin image 100 on the recording medium S satisfy the above Equation (2), the difference between the color of the powder 200 and the color of the resin image 100 can be made more inconspicuous.

Here, Equations (1) and (2) will be described.

In a general solid image, it is known that a difference in color value is hardly visually recognized by suppressing ΔE to equal to or less than 3. For example, ΔE of two colors ($L^*_1$, $a^*_1$, $b^*_1$) and ($L^*_2$, $a^*_2$, $b^*_2$) is expressed by the following Equation (3).

$$\Delta E=\{(L^*_2-L^*_1)^2+(a^*_2-a^*_1)^2+(b^*_2-b^*_1)^2\}^{1/2} \quad (3)$$

For example, when the lightness is the same (ΔL=0), if the difference in hue (Δa*b*) is equal to or less than 3, the difference in color value is hardly recognized For example, when the powder is fixed on the resin image, the coverage of the powder with respect to the resin image is about 30% to 80%, and the portion where the surface of the resin image is exposed is about 20% to 70% of the entire image. Therefore, in the resin image in which the powder is fixed to the surface, even if Δa*b* is large as compared with a general solid image, the difference in color value is hardly recognized. For example, when the coverage of the powder with respect to the resin image is about 70% and the portion where the surface of the resin image is exposed is about 30% of the entire image, it can be said that the difference in color value is hardly recognized even if Δa*b* is about 3.3 times larger than that of a general solid image, that is, even if Δa*b* is about 10. As a result, the above Equation (2) is derived.

Next, the difference in lightness (ΔL) is considered. In the metallic image, a result is obtained that the observer naturally feels the lightness of the image when the lightness of the powder is higher than the lightness of the resin image by about 40. Therefore, ΔL=40 is considered to be ideal. As described above, in the metallic image, since the type of light visually recognized varies depending on the observation direction, the lightness of the image visually recognized also varies depending on the observation direction. Specifically, high lightness is obtained in the specular reflection direction, and low lightness is obtained in the directions other than the specular reflection. Since the metallic image originally has such a characteristic that the lightness varies depending on the observation direction, the allowable width of ΔL in the metallic image is larger than the allowable width of Δa*b*. For example, even when ΔL is about larger by about 10 than the ideal value (40), the observer naturally feels the lightness of the metallic image decorated by the powder. Such ΔL and Δa*b* are correlated with each other, and when Δa*b* is small even if ΔL is somewhat large, the observer feels a metallic image naturally. The same applies to a case where Δa*b* is somewhat large and ΔL is small. As a result, the above Equation (1) is derived.

In the present embodiment, since the color value of the powder 200 is measured by the SCI method and the color value of the resin image 100 is measured by the SCE method, the difference between the color of the powder 200 and the color of the resin image 100 is more inconspicuous. This will be described below.

When the color value of the powder is measured, it is necessary to arrange the powder without a gap or fill a container with the powder to perform the measurement. Since it is practically impossible to arrange the powder without a gap, a method of filling a container to performing measurement is often used.

When the metallic powder is filled in the container and measured, the measurement is affected by the filling state of the powder in the container. In particular, in the case of a method of measuring only light reflected by specific reflection as in the SCE method, the influence becomes significant, and thus, in the case of measuring the metallic powder filled in the container, measurement by the SCI method is necessary.

The color of the powder measured by the SCI method is the same as the color of light when the powder is oriented on the resin image as viewed from the angle of specular reflection with respect to the light source. At this time, since the amount of reflected light from the powder greatly exceeds the amount of reflected light on the resin image, it is felt that only the reflected light from the powder is visually recognized. On the other hand, when viewed from an angle other than specular reflection with respect to the light source, the reflected light from the powder is not visually recognized, and only the diffuse reflection light from the resin image is visually recognized. It is preferable that a color when viewed from an angle of specular reflection with respect to this light source is the same as a color when viewed from an angle other than specular reflection.

In the present embodiment, the color value of the powder 200 is measured by the SCI method, the color value of the resin image is measured by the SCE method, and the numerical value is within the prescribed range. Therefore, the unevenness is hardly visually recognized when observed from any of the specular reflection direction and the direction other than specular reflection.

As described above, in the image forming system 1, since the color value of the resin image 100 and the color value of the powder 200 on the recording medium S satisfy Equation (1), the difference between the color of the resin image 100 and the color of the powder 200 is hardly visually recognized. Accordingly, the decorativeness by the powder 200 can be enhanced.

Hereinafter, modifications and other embodiments of the above-described embodiment will be described, but the same reference numerals are given to the same configurations as those of the above-described embodiment, and the description thereof will be omitted.

<Modification>

Figure 5:
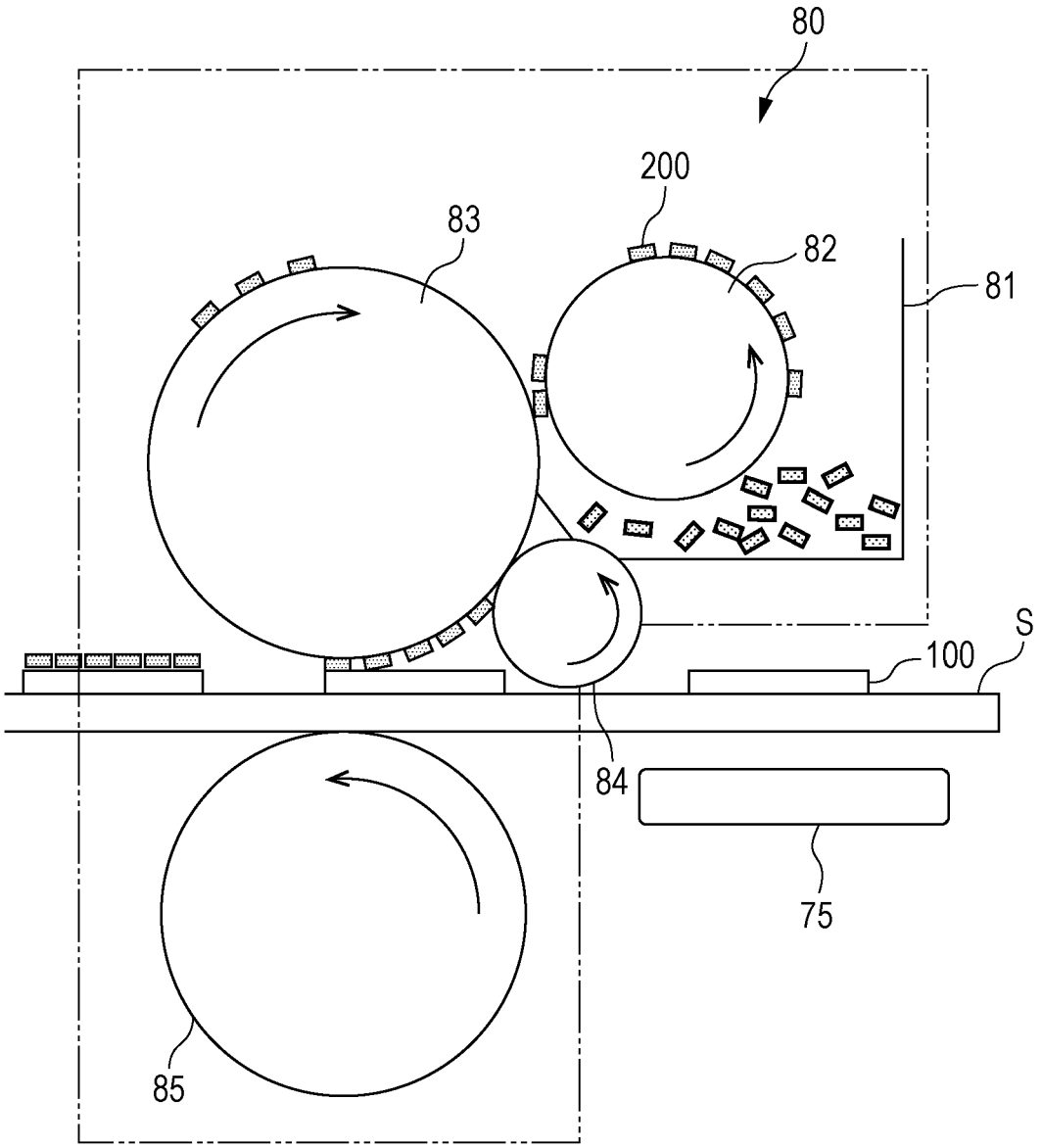
FIG. 5 is a schematic diagram illustrating a configuration of a post-processing device according to a modification.

FIG. 5 schematically illustrates a main part of the configuration of the post-processing device 80 according to a modification. The post-processing device 80 supplies thinned powder 200 onto the resin image 100. Except for this point, the post-processing device 80 according to the present modification has the same configuration as the post-processing device 70 described in the first embodiment, and has the same operation and effect.

The post-processing device 80 includes, for example, a container 81, a first supply roller 82, a transfer roller 83, a roller member 84, and an opposing roller 85. The post-processing device 80 may further include a heater 75 and a powder collecting part (for example, the powder collecting part 99 in FIG. 2). Here, the transfer roller 83 corresponds to a specific example of the powder supplier of the present invention.

The container 81 accommodates the powder 200. The container 81 is provided with an opening facing the transfer roller 83. An edge of the opening of the container 81 is able to contact, for example, the transfer roller 83. This makes it possible to control the amount of the powder 200 held by the transfer roller 83.

The first supply roller 82 is arranged inside the container 81 together with the powder 200, for example. When the first supply roller 82 rotates, the powder 200 stored in the container 81 is conveyed to the vicinity of the opening of the container 81.

The transfer roller 83 is arranged in the vicinity of the opening of the container 81. The powder 200 conveyed to the vicinity of the opening of the container 81 by the first supply roller 82 is held on the surface of the transfer roller 83 and supplied to the resin image 100 on the recording medium S. The transfer roller 83 includes a cylindrical core metal and an elastic layer provided on an outer peripheral surface of the core metal. The elastic layer is made of, for example, a resin sponge. The transfer roller 83 has a rotation shaft in a direction (for example, when the conveyance direction is the length direction of the recording medium S, the width direction of the recording medium S) intersecting the conveyance direction of the recording medium S, and is rotatable. The transfer roller 83 rotates, for example, clockwise (arrow direction in FIG. 5). The length of the transfer roller 83 in the axial direction is larger than the width of the recording medium S. The transfer roller 83 is biased to the roller member 84 by, for example, a biasing member (not illustrated).

The roller member 84 is provided in contact with the transfer roller 83. The bite amount of the roller member 84 into the transfer roller 83 is adjusted according to the supply amount of the powder 200, for example. The roller member 84 has, for example, a rotation shaft substantially parallel to the rotation shaft of the transfer roller 83, and is rotatable. The roller member 84 rotates in contact with the transfer roller 83, so that the powder 200 on the surface of the transfer roller 83 is rubbed. The rubbed powder 200 is oriented along the surface of the transfer roller 83, and a thin layer of the powder 200 is formed on the surface of the transfer roller 83. A thin layer of the powder 200 is supplied from the surface of the transfer roller 83 to the resin image 100 on the recording medium S.

The opposing roller 85 is arranged to face the transfer roller 83 with a conveyance path of the recording medium S therebetween. The opposing roller 85 has, for example, a rotation shaft substantially parallel to the rotation shaft of the transfer roller 83, and is rotatable. The opposing roller 85 rotates, for example, counterclockwise (arrow direction in FIG. 5). The recording medium S is conveyed in a predetermined direction by the rotation of the opposing roller 85.

As described above, the post-processing device 80 may supply a thin layer of the powder 200 to the resin image 100.

Second Embodiment

The image forming system 1 according to a second embodiment includes an adjusting device (an adjusting device 300 in FIG. 6 to be described later). The adjusting device 300 adjusts the color value of the resin image 100 and the color value of the powder 200 arranged on the recording medium S. Except for this point, the image forming system 1 according to the second embodiment has the same configuration as the image forming system 1 described in the first embodiment, and has the same operation and effect.

Figure 6:
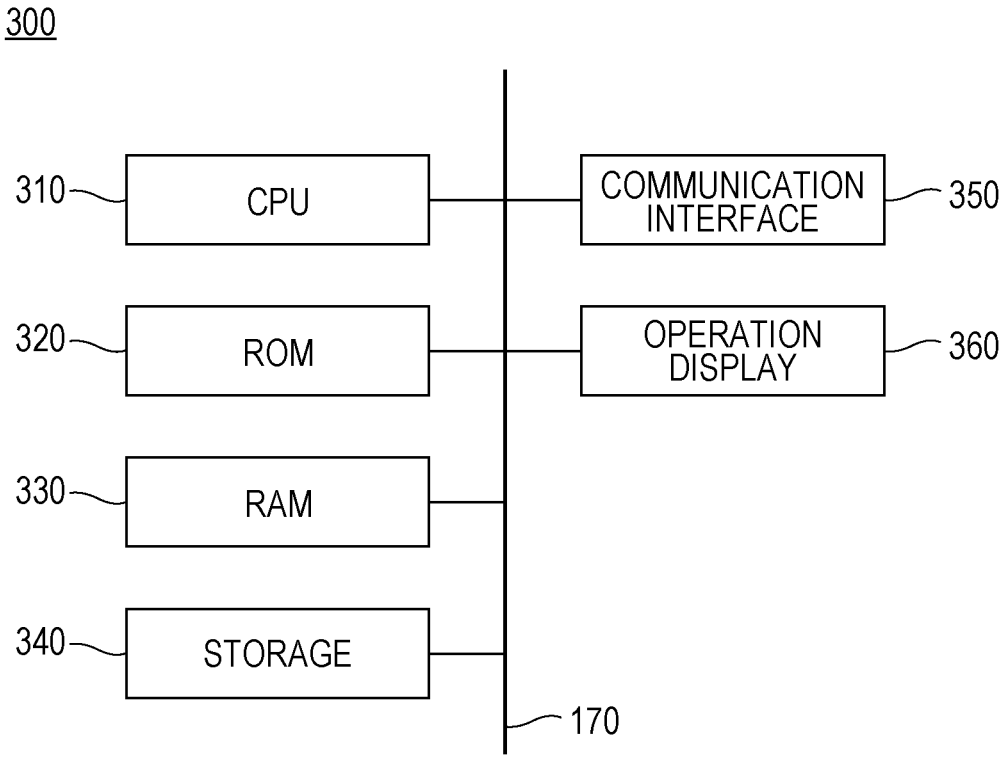
FIG. 6 is a block diagram illustrating an example of a configuration of an adjusting device included in an image forming system according to a second embodiment of the present invention.

FIG. 6 is a block diagram illustrating a schematic configuration of the adjusting device 300. The adjusting device 300 is, for example, a computer such as a server or a personal computer (PC). The adjusting device 300 may include a plurality of devices, and may be virtually configured as a cloud server by a large number of servers, for example. The adjusting device 300 includes a central processing unit (CPU) 310, a read only memory (ROM) 320, a random access memory (RAM) 330, a storage 340, a communication interface 350, and an operation display 360. The components are communicably connected to each other via a bus 370.

The CPU 310 performs control of each of the above-described configurations and various types of arithmetic processing according to a program recorded in the ROM 320 or the storage 340. A specific function of the CPU 310 will be described later. The ROM 320 stores various programs and various data. The RAM 330 temporarily stores programs and data as a work area.

The storage 340 stores various programs including an operating system and various data. For example, the storage 340 has installed therein an application for transmitting and receiving various types of information to and from other devices, and determining color values to be output on the basis of various types of information acquired from other devices. The storage 340 also stores candidates for information to be output and information necessary for determining color values to be output on the basis of various types of information.

The communication interface 350 is an interface for communicating with other devices. As the communication interface 350, a communication interface according to various wired or wireless standards is used.

The operation display 360 is, for example, a touch panel type display, and displays various types of information and receives various inputs from the user.

Figure 7:
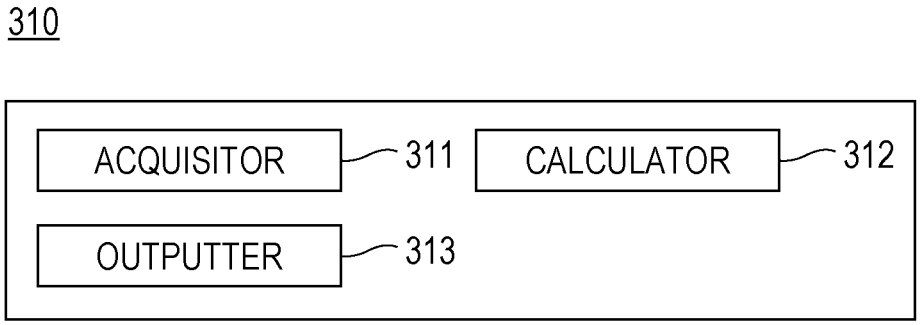
FIG. 7 is a block diagram illustrating an example of a functional configuration of the adjusting device illustrated in FIG. 6.

FIG. 7 is a block diagram illustrating an example of a functional configuration of the CPU 310. In the adjusting device 300, for example, the CPU 310 functions as the acquisitor 311, the calculator 312, and the outputter 313 by reading a program stored in the storage 340 and executing processing.

The acquisitor 311 acquires powder information on the color value of the powder 200. The powder information is, for example, information obtained by measuring the color value of the powder 200 using a spectrophotometer. The powder information may be transmitted from the spectrophotometer to the adjusting device 300, or may be input to the adjusting device 300 by an operator or the like. The acquisitor 311 may acquire image information regarding the color value of the resin image 100 on the recording medium S. The image information is, for example, information obtained by measuring the color value of the resin image 100 on the recording medium S using a fluorescence spectrophotometer.

The calculator 312 calculates the color value of the resin image 100 on the recording medium S satisfying the above Equation (1) using the powder information acquired by the acquisitor 311. The calculator 312 may calculate the color value of the powder 200 satisfying the above Equation (1) using the image information acquired by the acquisitor 311.

The outputter 313 outputs first color value information regarding the color value of the resin image 100 on the recording medium S calculated by the calculator 312. The outputter 313 may output second color value information regarding the color value of the powder 200 calculated by the calculator 312. The outputter 313 outputs, for example, the first color value information or the second color value information by displaying the first color value information or the second color value information on the operation display 360 or the like.

The image forming apparatus 60 may form the resin image 100 on the basis of the first color value information output from the adjusting device 300. Alternatively, the post-processing device 70 may supply the powder 200 onto the resin image 100 on the basis of the second color value information output from the adjusting device 300.

Figure 8:
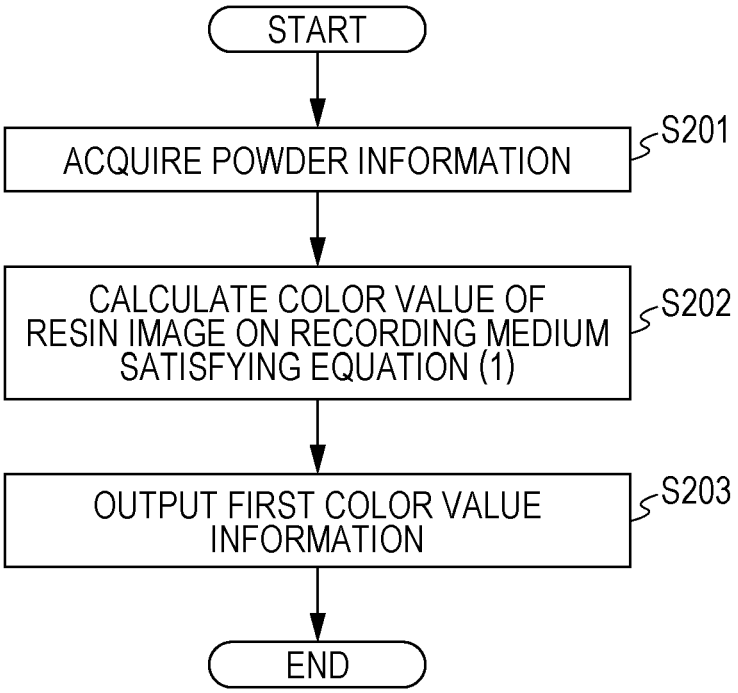
FIG. 8 is a flowchart illustrating an example of a processing method of the adjusting device illustrated in FIG. 6.

FIG. 8 is a flowchart illustrating a procedure of processing performed in the adjusting device 300. The processing by the adjusting device 300 is stored as a program in the storage 140 of the adjusting device 300, for example, and is performed by the CPU 310 controlling each part.

First, the adjusting device 300 acquires powder information on the color value of the powder 200 (step S201). Next, the adjusting device 300 calculates the color value of the resin image 100 on the recording medium S satisfying the above Equation (1) on the basis of the powder information acquired in step S101 (step S202). Thereafter, the adjusting device 300 outputs the first color value information regarding the color value of the resin image 100 on the recording medium S calculated in the processing of step S202 (step S203).

Alternatively, the adjusting device 300 may acquire image information regarding the color value of the resin image 100 on the recording medium S, calculate the color value of the powder 200 satisfying the above Equation (1) on the basis of the image information, and output second color value information regarding the color value of the powder 200.

As described above, the image forming system 1 may include the adjusting device 300 that adjusts the color value of the resin image 100 or the color value of the powder 200 on the recording medium S. In the image forming system 1, as similar to the description in the first embodiment, since the color value of the resin image 100 and the color value of the powder 200 on the recording medium S satisfy Equation (1), the difference between the color of the resin image 100 and the color of the powder 200 is hardly visually recognized. Accordingly, the decorativeness by the powder 200 can be enhanced.

<Other Modifications>

The image forming system 1 described in the above embodiment and modifications can be appropriately added, modified, and omitted by those skilled in the art within the scope of the technical idea. For example, the configuration, shape, size, and the like of each part of the image forming apparatus 60 and the post-processing device 70 described in the above embodiments are merely examples, and other configurations, shapes, sizes, and the like may be used. In addition, some members of the image forming apparatus 60 and the post-processing device 70 described in the above embodiment may be omitted, or other members may be added. For example, the post-processing device 70 may include a member that adjusts the amount of the powder 200 to be supplied to the resin image 100.

Further, the image forming system 1 may include an image forming apparatus that forms an image by another method such as an inkjet method instead of the electrophotographic image forming apparatus 60, but the image forming system 1 preferably includes the electrophotographic image forming apparatus 60. The toner particles used in the electrophotographic method generally contain a thermoplastic resin as a binder resin. Accordingly, in the toner image formed by the electrophotographic method, the softened resin layer is easily formed, and the powder 200 is easily brought into close contact with the image.

The powder 200 may be supplied to the surface of the toner image after the toner image is transferred to the recording medium S before the fixing step, but it is preferable to supply the powder 200 after the fixing step. The surface of the toner image (resin image 100) fixed to the recording medium S is uniformly and smoothly arranged. Therefore, burying of the powder in the softened resin layer is suppressed, and the powder 200 is easily arranged uniformly in the vicinity of the surface of the resin image 100.

In the first embodiment, the example on which the heater 75 is arranged in the vicinity of the powder spreading part 98 has been described. Alternatively, the heater 75 may be arranged upstream or downstream of the powder spreading part 98 in the conveyance direction X of the recording medium S. Alternatively, when the recording medium S is conveyed to the post-processing device 70, the resin image 100 may be softened, and at this time, the post-processing device 70 may not include the heater 75.

The method for softening the resin image 100 is not particularly limited. For example, the excessively heated resin image 100 may be cooled, or the heated resin image 100 may be kept warm. Alternatively, the resin image 100 may be softened by applying a solvent to the resin image 100.

The method for applying the solvent to the resin image 100 is not particularly limited. For example, the solvent can be applied to the resin image 100 by a spraying method, a wire bar method, a doctor blade method, an application method using a roller, or the like. The solvent applied to the resin image 100 is not particularly limited as long as the solvent can soften the resin image 100. For example, alcohols, ketones, hydrocarbon solvents, tetrahydrofuran, and the like can be applied to the resin image 100. The alcohols are, for example, methanol and ethanol, the ketones are, for example, acetone and methyl ethyl ketone, and the hydrocarbon solvents are, for example, pentane and hexane.

In the first embodiment, the example in which the rubbing roller 74 presses or rubs the surface of the resin image 100 has been described, but the member that presses or rubs the surface of the resin image 100 may be another member. For example, a non-rotating member may press or rub the surface of the resin image 100.

In the above embodiment and modification, the example in which the powder 200 has metallic luster has been described, but the powder 200 is not limited thereto.

EXAMPLE

Hereinafter, specific examples of the present embodiment will be described together with comparative examples. However, the technical scope of the present invention is not limited only to the following examples.

[Preparation of Black Dispersion]

11.5 parts by mass of sodium n-dodecyl sulfate was added to 160 parts by mass of ion-exchanged water, and dissolved and stirred to prepare an aqueous surfactant solution. To this aqueous surfactant solution, 15 parts by mass of a colorant (carbon black: MOGUL L) was gradually added, and dispersion treatment was performed using "CLEARMIX W-MOTION CLM-0.8" (manufactured by M Technique Co., Ltd., "CLEARMIX" is a registered trademark of M Technique Co., Ltd.). In this way, a liquid (black dispersion) in which fine particles of the black colorant were dispersed was prepared.

The particle size of the fine particles of the black colorant in the black dispersion was 220 nm in terms of volume-based median diameter. The volume-based median diameter was determined by measuring under the following measurement conditions using "MICROTRAC UPA-150" (manufactured by MicrotracBEL Corp.).

Sample refractive index: 1.59

Sample specific gravity: 1.05 (in terms of spherical particles)

Solvent refractive index: 1.33

Solvent viscosity: 0.797 (30° C.), 1.002 (20° C.)

Zero point adjustment: Ion-exchanged water was added to the measurement cell for adjustment.

[Preparation of Yellow Dispersion]

A liquid (yellow dispersion) in which fine particles of a yellow colorant were dispersed was prepared in the same manner as in the preparation of the black dispersion except that "CI Pigment Yellow 74" was used instead of "carbon black: MOGUL L".

[Preparation of Magenta Dispersion]

A liquid (magenta dispersion) in which fine particles of a magenta colorant were dispersed was prepared in the same manner as in the preparation of the black dispersion except that "CI Pigment Red 122" was used instead of "carbon black: MOGUL L".

[Preparation of Cyan Dispersion]

A liquid (cyan dispersion) in which fine particles of a cyan colorant were dispersed was prepared in the same manner as in the preparation of the black dispersion except that "C.I. Pigment Blue 15:3" was used instead of "carbon black: MOGUL L".

The particle diameter of the fine particles of the yellow colorant in the yellow dispersion was 140 nm in the median diameter, the median diameter of the fine particles of the magenta colorant in the magenta dispersion was 130 nm, and the median diameter of the fine particles of the cyan colorant in the cyan dispersion was 110 nm.

[Production of Resin Particles for Core]

Resin particles for core having a multilayer structure were produced through the following first-stage polymerization, second-stage polymerization, and third-stage polymerization.

(a) First-Stage Polymerization

A reaction vessel equipped with a stirrer, a temperature sensor, a cooling tube, and a nitrogen introduction device was charged with an aqueous surfactant solution 1 prepared by dissolving 4 parts by mass of sodium polyoxyethylene-2-dodecyl ether sulfate in 3040 parts by mass of ion-exchanged water, and the temperature of the solution was raised to 80° C. while stirring the solution at a stirring speed of 230 rpm under a nitrogen stream.

A polymerization initiator solution 1 prepared by dissolving 10 parts by mass of potassium persulfate in 400 parts by mass of ion-exchanged water was added to the aqueous surfactant solution 1, the temperature of the resulting mixed liquid was raised to 75° C., and then a monomer mixed liquid 1 containing the following components in the following amounts was added dropwise to the mixed liquid over 1 hour:

| | |
|---|---|
| Styrene | 532 parts by mass |
| n-Butyl acrylate | 200 parts by mass |
| Methacrylic acid | 68 parts by mass |
| n-octyl mercaptan | 16.4 parts by mass |

The monomer mixed liquid 1 was added dropwise, and then the obtained reaction liquid was heated and stirred at 75° C. over 2 hours to perform polymerization (first-stage polymerization), thereby producing resin particles A1.

(b) Second-Stage Polymerization

Into a flask equipped with a stirrer, a monomer mixed liquid 2 containing the following components in the following amounts was charged, 93.8 parts by mass of paraffin wax "HNP-57" (manufactured by NIPPON SEIRO CO., LTD.) was added as a release agent, and the mixture was heated to 90° C. for dissolution:

| | |
|---|---|
| Styrene | 101.1 parts by mass |
| n-Butyl acrylate | 62.2 parts by mass |
| Methacrylic acid | 12.3 parts by mass |
| n-Octyl mercaptan | 1.75 parts by mass |

On the other hand, an aqueous surfactant solution 2 was produced by dissolving 3 parts by mass of sodium polyoxyethylene-2-dodecyl ether sulfate in 1560 parts by mass of ion-exchanged water, and heated to 98° C. To the aqueous surfactant solution 2, 32.8 parts by mass of the resin particles A1 was added, and the monomer mixed liquid 2 was further added, and then the mixture was mixed and dispersed for 8 hours with a mechanical disperser "CLEARMIX" (manufactured by M Technique Co., Ltd.) having a circulation path. By this mixing and dispersion, an emulsion particle dispersion 1 containing emulsion particles having a dispersion particle size of 340 nm was produced.

Next, a polymerization initiator solution 2 prepared by dissolving 6 parts by mass of potassium persulfate in 200 parts by mass of ion-exchanged water was added to this emulsion particle dispersion 1, and the resulting mixed liquid was heated and stirred at 98° C. for 12 hours to perform polymerization (second-stage polymerization), thereby producing resin particles A2, and obtaining a dispersion containing the resin particles A2.

(c) Third-Stage Polymerization

A polymerization initiator solution 3 prepared by dissolving 5.45 parts by mass of potassium persulfate in 220 parts by mass of ion-exchanged water was added to the dispersion containing the resin particles A2, and a monomer mixed liquid 3 containing the following components in the following amounts was added dropwise to the obtained dispersion over 1 hour under a temperature condition of 80° C.:

| | |
|---|---|
| Styrene | 293.8 parts by mass |
| n-Butyl acrylate | 154.1 parts by mass |
| n-Octyl mercaptan | 7.08 parts by mass |

After completion of the dropwise addition, the mixture was heated and stirred for 2 hours to perform polymerization (third-stage polymerization), and after completion of the polymerization, the mixture was cooled to 28° C. to produce resin particles for core.

[Production of Resin Particles for Shell]

A polymerization reaction and a treatment after the reaction were performed in the same manner as in the production of the resin particles for core except that the monomer mixed liquid 1 used in the first-stage polymerization was changed to a monomer mixed liquid 4 containing the following components in the following amounts:

| | |
|---|---|
| Styrene | 624 parts by mass |
| 2-ethylhexyl acrylate | 120 parts by mass |

-continued

| | |
|---|---|
| Methacrylic acid | 56 parts by mass |
| n-octyl mercaptan | 16.4 parts by mass |

[Production of Black Toner Particles]

(a) Production of Core Part

In a reaction vessel equipped with a stirrer, a temperature sensor, a cooling tube, and a nitrogen introduction device, the following components were added in the following amounts and stirred. The temperature of the resulting mixed liquid was adjusted to 30° C., and then a 5 mol/liter aqueous sodium hydroxide solution was added to the mixed liquid to adjust the pH to 8 to 11:

| | |
|---|---|
| Resin particles for core | 420.7 parts by mass |
| Ion-exchanged water | 900 parts by mass |
| Black dispersion | 300 parts by mass |

Subsequently, an aqueous solution obtained by dissolving 2 parts by mass of magnesium chloride hexahydrate in 1000 parts by mass of ion-exchanged water was added to the mixed liquid described above over 10 minutes at 30° C. under stirring. After the mixed liquid was left for 3 minutes, the temperature of the mixed liquid was started to be raised, and the mixed liquid was raised to 65° C. over 60 minutes to associate the particles in the mixed liquid. In this state, the particle diameter of the associated particles was measured using "Multisizer 3" (manufactured by Beckman Coulter, Inc.), and when the volume-based median diameter of the associated particles reached 5.8 μm, an aqueous solution obtained by dissolving 40.2 parts by mass of sodium chloride in 1000 parts by mass of ion-exchanged water was added to the mixed liquid to stop the association of the particles.

After the association was stopped, further, as an aging treatment, the liquid temperature was set to 70° C., and heating and stirring was performed for 1 hour to continue the fusion of the associated particles, thereby producing a core part. The average circularity of the core part was measured by "FPIA 2100" (manufactured by Sysmex Corporation, "FPIA" is a registered trademark of Sysmex Corporation) and found to be 0.912.

(b) Production of Shell

Next, the mixed liquid was adjusted to 65° C., 50 parts by mass of resin particles for shell were added to the mixed liquid, and an aqueous solution obtained by dissolving 2 parts by mass of magnesium chloride hexahydrate in 1000 parts by mass of ion-exchanged water was further added to the mixed liquid over 10 minutes. Thereafter, the mixed liquid was heated to 70° C. and stirred for 1 hour. In this way, the resin particles for shell were fused to the surface of the core part, and then aged at 75° C. for 20 minutes to form a shell.

Thereafter, an aqueous solution obtained by dissolving 40.2 parts by mass of sodium chloride in 1000 parts by mass of ion-exchanged water was added to stop the formation of the shell. Further, the mixed liquid was cooled to 30° C. at a rate of 8° C./min. The generated particles were filtered, repeatedly washed with ion-exchanged water at 45° C., and then dried with hot air at 40° C. to produce black toner base particles having a shell covering the surface of the core part.

(c) External Additive Adding Step

The following external additives were added to the black toner base particles, and external addition treatment was performed with "Henschel mixer (registered trademark, the same applies hereinafter)" (manufactured by NIPPON COKE & ENGINEERING CO., LTD.) to produce black toner particles:

| | |
|---|---|
| Silica fine particles treated with hexamethylsilazane | 0.6 parts by mass |
| n-octylsilane-treated titanium dioxide fine particles | 0.8 parts by mass |

The external addition treatment with the Henschel mixer was performed under the conditions of a peripheral speed of a stirring blade of 35 m/sec, a treatment temperature of 35° C., and a treatment time of 15 minutes. The particle size of the silica fine particles of the external additive was 12 nm in terms of volume-based median diameter, and the particle size of the titanium dioxide fine particles was 20 nm in terms of volume-based median diameter.

[Production of Yellow Toner Particles]

Yellow toner particles were produced in the same manner as in the production of the black toner particles except that the yellow dispersion was used instead of the black dispersion.

[Production of Magenta Toner Particles]

Magenta toner particles were produced in the same manner as in the production of the black toner particles except that the magenta dispersion was used instead of the black dispersion.

[Production of Cyan Toner Particles]

Cyan toner particles were produced in the same manner as in the production of the black toner particles except that the cyan dispersion was used instead of the black dispersion.

[Production of Clear Toner Particles]

Clear toner particles were produced in the same manner as in the production of black toner particles except that an aqueous surfactant solution obtained by mixing 18.5 parts by mass of sodium n-dodecyl sulfate with 281.5 parts by mass of ion-exchanged water was used instead of the black dispersion.

[Production of Developer]

Ferrite carrier particles having a volume average particle diameter of 40 μm, the surfaces of which were covered with a copolymer of methyl methacrylate and cyclohexyl methacrylate, were mixed with black toner particles, yellow toner particles, magenta toner particles, cyan toner particles, white toner particles, and clear toner particles in an amount that the toner concentration was 6 mass %, thereby producing a black developer, a yellow developer, a magenta developer, a cyan developer, a white developer, and a clear developer.

[Preparation of Recording Medium]

The following recording medium was prepared.

Recording medium: "OK Topcoat+157 g/m$^2$" manufactured by Oji Paper Co., Ltd.

[Preparation of Powder]

The following three types of powders having metallic luster of silver, gold, and copper were prepared.

Silver: "ELgee neo #325 SILVER" manufactured by OIKE & Co., Ltd.

Gold: "ELgee neo #325 S-GOLD" manufactured by OIKE & Co., Ltd.

Copper: "ELgee neo #325 COPPER" manufactured by OIKE & Co., Ltd.

The color values of the silver powder measured under the following conditions were $L^*_p$=86.21, $a^*_p$=−0.52, $b^*_p$=−1.3, the color values of the gold powder were $L^*_p$=78.67, $a^*_p$=0.77, $b^*_p$=33.72, and the color values of the copper powder were $L^*_p$=69.14, $a^*_p$=19.64, $b^*_p$=19.28.

Measuring apparatus: Spectrophotometer CM-3600d manufactured by KONICA MINOLTA, INC.

Cell: glass cell CM-A98 (optical path length 10 mm, powder 200 is filled in height of 20 mm)

Measurement diameter: 8 mm

Measurement method: Specular Component Include (SCI)

Light source: D50

Observation conditions: 2° field of view

EXAMPLE 1

The black developer and the clear developer were accommodated in a modified machine of "AccurioPressC6100" (manufactured by Konica Minolta, Inc., "AccurioPress" is a registered trademark of the company), and a square resin image of 3 cm×3 cm was formed on a recording medium using the modified machine. The modified machine outputs the resin image with CL100, K80. The color values of the resin image measured under the following conditions were $L^*_i$=33.95, $a^*_i$=−0.17, $b^*_i$=0.93:

Measuring apparatus: Fluorescence spectrophotometer FD-7 manufactured by KONICA MINOLTA, INC.

Measurement method: SCE (Specular Component Exclude)

Light source: D50

Observation conditions: 2° field of view

The recording medium on which the resin image was formed was placed on a hot plate heated to 110° C., and the silver powder was spread on the resin image. Thereafter, the surface of the resin image on which the powder was spread was rubbed with a sponge roller. The pressing force during rubbing was about 10 kPa. After rubbing, the resin image was cooled under room temperature conditions, and the remaining powder was removed from the surface of the resin image with a brush to obtain a metallic image. The color value of the resin image and the color value of the powder satisfied the above Equations (1) and (2).

EXAMPLE 2

A resin image was formed on a recording medium in the same manner as in Example 1 except that a resin image was formed by accommodating a cyan developer, a magenta developer, a yellow developer, and a clear developer in a modified machine. The modified machine outputs the resin images with C40, M40, Y80, CL100. The color values of the resin image measured under the same conditions as those of above Example 1 were $L^*_i$=40.49, $a^*_i$=8.79, $b^*_i$=15.24. The color value of the resin image and the color value of the powder satisfied the above Equation (1).

EXAMPLE 3

A resin image was formed on a recording medium in the same manner as in Example 1 except that a resin image was formed by accommodating a cyan developer, a magenta developer, and a yellow developer in a modified machine, and a gold powder was spread on the resin image. The modified machine outputs the resin images with C40, M20, Y100. The color values of the resin image measured under the same conditions as those of above Example 1 were $L^*_i$=51.17, $a^*_i$=2.28, $b^*_i$=41.53. The color value of the resin image and the color value of the powder satisfied the above Equations (1) and (2).

EXAMPLE 4

A resin image was formed on a recording medium in the same manner as in Example 1 except that a resin image was formed by accommodating a cyan developer, a magenta developer, and a yellow developer in a modified machine, and a gold powder was spread on the resin image. The modified machine outputs the resin images with C60, M20, Y100. The color values of the resin image measured under the same conditions as those of above Example 1 were $L^*_i$=45.28, $a^*_i$=13.25, $b^*_i$=32.73. The color value of the resin image and the color value of the powder satisfied the above Equation (1).

EXAMPLE 5

A resin image was formed on a recording medium in the same manner as in Example 1 except that a resin image was formed by accommodating a cyan developer, a magenta developer, and a yellow developer in a modified machine, and a copper powder was spread on the resin image. The modified machine outputs the resin images with C60, M80, Y100. The color values of the resin image measured under the same conditions as those of above Example 1 were $L^*_i$=28.27, $a^*_i$=18.54, $b^*_i$=18.47. The color value of the resin image and the color value of the powder satisfied the above Equations (1) and (2).

EXAMPLE 6

A resin image was formed on a recording medium in the same manner as in Example 1 except that a resin image was formed by accommodating a cyan developer, a magenta developer, and a yellow developer in a modified machine, and a copper powder was spread on the resin image. The modified machine outputs the resin images with C40, M80, Y100. The color values of the resin image measured under the same conditions as those of above Example 1 were $L^*_i$=32.92, $a^*_i$=28.95, $b^*_i$=25.55. The color value of the resin image and the color value of the powder satisfied the above Equation (1).

COMPARATIVE EXAMPLE 1

A resin image was formed on a recording medium in the same manner as in Example 1 except that a resin image was formed by accommodating only a black developer in a modified machine. The modified machine outputs the resin image with K100. The color values of the resin image measured under the same conditions as those of above Example 1 were $L^*_i$=11.36, $a^*_i$=0.22, $b^*_i$=0.48. The color value of the resin image and the color value of the powder did not satisfy the above Equations (1) and (2).

COMPARATIVE EXAMPLE 2

A resin image was formed on a recording medium in the same manner as in Examples 3 and 4 except that a resin image was output with C80, M20, Y100 by a modified machine. The color values of the resin image measured under the same conditions as those of above Example 1 were $L^*_i$=40.02, $a^*_i$=25.62, $b^*_i$=24.3. The color value of the resin image and the color value of the powder did not satisfy the above Equations (1) and (2).

COMPARATIVE EXAMPLE 3

A resin image was formed on a recording medium in the same manner as in Examples 5 and 6 except that a resin image was output with C100, M80, Y100 by a modified machine. The color values of the resin image measured under the same conditions as those of above Example 1 were $L^*_i$=19.61, $a^*_i$=5.06, $b^*_i$=5.66. The color value of the resin image and the color value of the powder did not satisfy the above Equations (1) and (2).

[Evaluation Method]

The appearance of the metallic image formed in Example 1 to 6 and Comparative Example 1 to 3 was visually evaluated by 10 observers under a standard light source D50. The observer evaluated the metallic images formed in Example 1 to 6 and Comparative Example 1 to 3 for the three evaluation items of naturalness of brightness, naturalness of color tone, and uniformity (unevenness inconspicuousness). For each of the naturalness of brightness and the naturalness of color tone, the number of observers who were evaluated as "natural" was counted. For the uniformity, the number of observers who evaluated "uniform (unevenness is not conspicuous)" was counted. Metallic images evaluated as "natural" and "uniform (unevenness is not inconspicuous)" by seven or more observers were regarded as images in which the difference between the color of the resin image and the color of the powder is hardly visually recognized, that is, pass.

The conditions and evaluation results of the above Examples and Comparative Examples are shown in Table 1. ΔE and Δa*b* in Table 1 are expressed by the following Equations (4) and (5).

$$\Delta E=\{(L^*_p-L^*_i-40)^2+(a^*_p-a^*_i)^2+(b^*_p-b^*_i)^2\}^{1/2} \quad (4)$$

$$\Delta a^*b^*\{(a^*_p-a^*_i)^2+(b^*_p-b^*_i)^2\}^{1/2} \quad (4)$$

TABLE 1

| | | Output value of image | | | | | Color value of image | | | Color value of powder | | | | | Evaluation | | |
|---|---|---|---|---|---|---|---|---|---|---|---|---|---|---|---|---|---|
| | | | | | | | | | | | | | | | Color | | |
| | Powder | C | M | Y | K | CL | $L^*_i$ | $a^*_i$ | $b^*_i$ | $L^*_p$ | $a^*_p$ | $b^*_p$ | ΔE | Δa*b* | Brightness | tone | Uniformity |
| Example 1 | Silver | 0 | 0 | 0 | 80 | 100 | 33.95 | −0.17 | 0.93 | 86.21 | −0.52 | −1.3 | 12.5 | 2.3 | 9 | 10 | 10 |
| Example 2 | Silver | 40 | 40 | 80 | 0 | 100 | 40.49 | 8.79 | 15.24 | 86.21 | −0.52 | −1.3 | 19.8 | 19.0 | 8 | 7 | 9 |
| Example 3 | Gold | 40 | 20 | 100 | 0 | 0 | 51.17 | −2.28 | 41.53 | 78.67 | 0.77 | 33.72 | 15.1 | 8.4 | 8 | 9 | 10 |
| Example 4 | Gold | 60 | 20 | 100 | 0 | 0 | 45.28 | −13.25 | 32.73 | 78.67 | 0.77 | 33.72 | 15.5 | 14.1 | 8 | 7 | 9 |
| Example 5 | Copper | 60 | 80 | 100 | 0 | 0 | 28.27 | 18.54 | 18.47 | 69.14 | 19.64 | 19.28 | 1.6 | 1.4 | 10 | 10 | 10 |
| Example 6 | Copper | 40 | 80 | 100 | 0 | 0 | 32.92 | 28.95 | 25.55 | 69.14 | 19.64 | 19.28 | 11.8 | 11.2 | 9 | 8 | 9 |
| Comparative Example 1 | Silver | 0 | 0 | 0 | 100 | 0 | 11.36 | −0.22 | −0.48 | 86.21 | −0.52 | −1.3 | 34.9 | 0.9 | 4 | 10 | 5 |
| Comparative Example 2 | Gold | 80 | 20 | 100 | 0 | 0 | 40.02 | −25.62 | 24.3 | 78.67 | 0.77 | 33.72 | 28.1 | 28.0 | 5 | 0 | 3 |
| Comparative Example 3 | Copper | 100 | 80 | 100 | 0 | 0 | 19.61 | −5.06 | 5.66 | 69.14 | 19.64 | 19.28 | 29.8 | 28.2 | 4 | 0 | 2 |

From the results in Table 1, it was confirmed that in Example 1 to 6, the difference between the color of the resin image and the color of the powder was less likely to be visually recognized as compared with Comparative Example 1 to 3. In particular, in Examples 1, 3, and 5, since the color value of the resin image and the color value of the powder satisfied the Equation (2) in addition to the Equation (1), it was confirmed that the difference between the color of the resin image and the color of the powder was less likely to be visually recognized Although embodiments of the present invention have been described and illustrated in detail, the disclosed embodiments are made for purposes of illustration and example only and not limitation. The scope of the present invention should be interpreted by terms of the appended claims

What is claimed is:

1. An image forming method comprising supplying powder having metallic luster on a resin image arranged on a recording medium, wherein a color value of the resin image and a color value of the powder on the recording medium satisfy the following Equation (1):

$$\{(L^*_p-L^*_i-40)^2+(a^*_p-a^*_i)^2+(b^*_p-b^*_i)^2\}^{1/2}\leq 20 \quad (1)$$

wherein $L^*_p$, $a^*_p$, and $b^*_p$ represent color values of the powder, and $L^*_i$, $a^*_i$, and $b^*_i$ represent color values of the resin image on the recording medium.

2. The image forming method according to claim 1, wherein the color value of the resin image and the color value of the powder on the recording medium further satisfy the following Equation (2):

$$\{(a^*_p-a^*_i)^2+(b^*_p-b^*_i)^2\}^{1/2}\leq 10 \quad (2).$$

3. The image forming method according to claim 1, wherein the color value of the powder is measured including specular reflection light, and the color value of the resin image on the recording medium is measured not including the specular reflection light.

4. The image forming method according to claim 1, further comprising softening the resin image.

5. The image forming method according to claim 1, further comprising forming the resin image on the recording medium.

6. The image forming method according to claim 1, wherein the resin image is formed by an electrophotographic method.

7. The image forming method according to claim 1, wherein the resin image is arranged on the recording medium by attaching an image forming material to the recording medium in an amount of equal to or greater than 2 $g/m^2$ and equal to or less than 20 $g/m^2$.

8. The image forming method according to claim 1, wherein the resin image on the recording medium is a solid color image.

9. A post-processing device comprising a powder supplier that supplies powder having metallic luster on a resin image arranged on a recording medium, wherein a color value of the resin image and a color value of the powder on the recording medium satisfy the following Equation (1):

$$\{(L^*_p-L^*_i-40)^2+(a^*_p-a^*_i)^2+(b^*_p-b^*_i)^2\}^{1/2}\leq 20 \quad (1)$$

wherein $L^*_p$, $a^*_p$, and $b^*_p$ represent color values of the powder, and $L^*_i$, $a^*_i$, and $b^*_i$ represent color values of the resin image on the recording medium.

10. An adjusting device for adjusting a color value of a resin image arranged on a recording medium and a color value of powder having metallic luster supplied onto the resin image on the recording medium, the adjusting device comprising a hardware processor that:

acquires powder information regarding a color value of the powder; and outputs first color value information regarding the color value of the resin image on the recording medium satisfying the following Equation (1) using the acquired powder information:

$$\{(L^*_p-L^*_i-40)^2+(a^*_p-a^*_i)^2+(b^*_p-b^*_i)^2\}^{1/2}\leq 20 \quad (1)$$

wherein $L^*_p$, $a^*_p$, and $b^*_p$ represent color values of the powder, and $L^*_i$, $a^*_i$, and $b^*_i$ represent color values of the resin image on the recording medium.

11. An adjusting device for adjusting a color value of a resin image arranged on a recording medium and a color value of powder having metallic luster supplied onto the resin image on the recording medium, the adjusting device comprising a hardware processor that:

acquires image information regarding a color value of the resin image on the recording medium; and outputs second color value information regarding a color value of the powder satisfying the following Equation (1) using the acquired image information:

$$\{(L^*_p-L^*_i-40)^2+(a^*_p-a^*_i)^2+(b^*_p-b^*_i)^2\}^{1/2}\leq 20 \quad (1)$$

wherein $L^*_p$, $a^*_p$, and $b^*_p$ represent color values of the powder, and $L^*_i$, $a^*_i$, and $b^*_i$ represent color values of the resin image on the recording medium.

* * * * *